US006142963A

United States Patent [19]

Black et al.

[11] Patent Number: 6,142,963

[45] Date of Patent: Nov. 7, 2000

[54] VIBRATING BABY BLANKET

[76] Inventors: John W. Black, Rte. #1, Box 100-H, Jusstin; Rebecca L. Dockery, Rte. #1, Box 100-H, Justin, both of Tex. 76247

[21] Appl. No.: 09/037,923

[22] Filed: Mar. 10, 1998

[51] Int. Cl.[7] ..... A61H 1/00

[52] U.S. Cl. ..... 601/57; 601/84; 601/56

[58] Field of Search ..... 601/46, 56, 57, 601/58, 59, 60, 84, 89, 93

[56] References Cited

U.S. PATENT DOCUMENTS

| | | | |
|---|---|---|---|
| 3,075,101 | 1/1963 | Neff | 601/78 |
| 3,552,388 | 1/1971 | Zelenke | 128/55 |
| 3,799,154 | 3/1974 | Knop | 128/24.2 |
| 4,136,685 | 1/1979 | Ramey | 601/57 |
| 4,228,793 | 10/1980 | Ramey | 601/57 |
| 4,608,967 | 9/1986 | Piro | 128/61 |
| 4,681,096 | 7/1987 | Cuervo | 128/33 |
| 4,694,839 | 9/1987 | Timme | 128/721 |
| 4,872,422 | 10/1989 | Della Vecchia | 119/83 |
| 4,951,331 | 8/1990 | Pereira | 5/109 |
| 5,063,912 | 11/1991 | Hughes | 601/47 |
| 5,582,582 | 12/1996 | Chapman | 601/112 |
| 5,865,771 | 2/1999 | Shuto et al. | 601/57 |

*Primary Examiner*—Mickey Yu
*Assistant Examiner*—Benjamin Koo
*Attorney, Agent, or Firm*—John D. Gugliotta

[57] ABSTRACT

A vibrating baby blanket is disclosed, comprising a traditional baby blanket. Located inside of the blanket is a vibrating mechanism, the approximate size of an adult's outstretched hand, which produces vibrations to simulate the patting of a parent on a child's back. The vibrating mechanism is adjustable in frequency and intensity. The blanket is decoratively adorned, and plays music via an electronic music box, located inside of a control unit. The control unit and vibrating mechanism are located inside of a pocket on the blanket, thus permitting them to be removed when the blanket needs washing. Power is supplied by a detachable power cord and direct current power supply, as well as a rechargeable batteries. A portable pad is also disclosed.

8 Claims, 6 Drawing Sheets

VIBRATING BABY BLANKET

BACKGROUND OF THE INVENTION

1. Field of the Invention

The present invention relates generally to baby blankets, and, more particularly, to a vibrating baby blanket.

2. Description of the Related Art

Children are a blessed addition to a family. As every parent knows, infants require considerable love and attention to ensure that the child grows up normally and flourishes. The sensation of touch is particularly important for children to experience constantly. The sensation of touch lets the child know that he or she is cared for, safe and loved. Babies, especially newborns, frequently require that they be patted or stroked to assist them to relax and fall asleep. Softly patting the child on the back seems to be particularly effective in accomplishing this. Patting the child on the back with slightly more force is also performed to 'burp' the child, assisting the infant in releasing air from the stomach that was swallowed during feeding.

Such patting is also helpful in treating babies with colic. Colic, although difficult to define, is an unexplained irritability, fussing, crying and often sustained screaming.

Providing this constant patting is sometimes difficult for busy parents. Their hands frequently fatigue from patting the child, especially while holding the child. Also, when the child is in its crib, it is difficult to pat the child without removing him or her from the crib.

The previous art includes several devices designed to relax a child with a vibrating motion. In general, these devices include a motor, a vibrating mechanism, and a rod portion that vibrates, and are self-standing units that attach to a mattress or underside of a baby crib. Examples of this type of device include U.S. Pat. No. 4,951,331, issued in the name of Pereira, U.S. Pat. No. 4,681,096, issued in the name of Cuervo, U.S. Pat. No. 3,799,154, issued in the name of Knop, and U.S. Pat. No. 3,552,388, issued in the name of Zelenka.

There are several problems with this type of device. First, the devices are bulky, and therefore, not portable. Second, the devices can only be used in a crib. Third, the devices are heavy, and as such, cannot be placed on the child. Fourth, the devices vibrate the entire crib, thus making it impossible to simulate the patting motion of a loving care-giver. Fifth, the devices are loud, thus disturbing the child's sleep patterns.

U.S. Pat. No. 4,694,839, issued in the name of Timme, discloses a sleep apnea monitoring system with electrodes which provide a localized vibration to wake the child up if it is not breathing. This device obviously does not serve the function of relaxing the child and helping it to fall asleep.

Other devices, such as that disclosed in U.S. Pat. No. 5,582,582, issued in the name of Chapman, are complete body massage machines which rest over a grown person's entire body, with legs elevating the device above the ground or table being used. Such a device is unsuitable for use with a child for several reasons. It is bulky, noisy, expensive, dangerously heavy, not portable, and does not provide localized vibration to simulate patting.

Other devices attempt to simulate a patting motion on a person's back. U.S. Pat. No. 4,608,967, issued in the name of Piro, discloses a mechanical patting apparatus which rests on an adult's shoulder. The device is designed to be used by the person being patted, and as such, its function is inapplicable to the application of the present invention. Furthermore, the device requires the operator to move a handle to actuate the patting mechanism, and as such, does not provide relief for hand fatigue caused by patting another.

A search of the prior art did not disclose any patents that read directly on the claims of the instant invention. Consequently, a need has been felt for providing an apparatus and method which overcomes the problems cited above.

SUMMARY OF THE INVENTION

It is therefore an object of the present invention to provide an improved, vibrating baby blanket that simulates the patting motion of a care-giver's hand on a child's back. The device produces a soothing vibration against a child's back, simulating the stroking motion of a loving parent's hand.

Briefly described according to one embodiment of the present invention, the vibrating baby blanket is comprised of a traditional baby blanket. Located inside of the blanket is a vibrating mechanism, the approximate size of an adult's outstretched hand, which produces vibrations to simulate the patting of a parent on a child's back. The vibrating mechanism is adjustable in frequency and intensity. The blanket is decoratively adorned, and plays music via an electronic music box, located inside of a control unit. The control unit and vibrating mechanism are located inside of a pocket on the blanket, thus permitting them to be removed when the blanket needs washing. Power is supplied by a detachable power cord and a direct current power supply. An alternate method of power generation is a rechargeable battery set. A portable pad is also disclosed.

It is another object of the present invention to provide a device that produces a stroking/patting motion that soothes and calms infants. This can help a child to sleep better and longer. This has several benefits. First, hand fatigue of care-givers is reduced, since they do not have to constantly rub the child's back. Second, the device frees parents to attend to domestic chores during this sleep. Third, the care-givers will be able to receive more rest, thus enabling them to more efficiently care for the child. In addition, the device can also be used while the infant is sleeping to provide continual comfort.

It is another object of the present invention to provide a device that functions as an adjunct to traditional baby patting, being used when it is difficult to hold and comfort a child, such as when they are in their crib. In addition, the device can be used while the care-giver is holding the child, to provide additional comfort to the child when the care-giver's hand tires from constant patting.

It is another object of the present invention to provide a device that functions to assist the care-giver in burping an infant.

It is another object of the present invention to provide a vibrating mechanism whose surface area is approximately the size of a human hand with fingers outstretched, thus creating the sensation of a hand patting the child.

It is another object of the present invention to provide a vibrating mechanism that has variable speed setting, thus allowing the care-giver to adjust the vibration rate to the preferences of the child.

It is another object of the present invention to provide a vibrating mechanism that has an intensity speed setting, thus allowing the care-giver to adjust the intensity to either comfort or burp the child.

It is another object of the present invention to provide a device that is fire retardant, so as to ensure the safety of the child during use. This is accomplished by using fire-retardant cotton or flannel.

It is another object of the present invention to provide a device that either utilizes a battery power source, or can be detachably plugged into a conventional outlet. This allows the vibrating baby blanket to be used outdoors and indoors.

It is another object of the present invention to provide a device that can be used as a regular blanket or as a massaging blanket.

It is another object of the present invention to provide a device that provides music for a child.

It is another object of the present invention to provide a device that can be used by anyone caring for a child, such as a parent, grandparents, baby sitters, hospital employees.

It is another object of the present invention to provide a device that can be easily produced using existing technology, materials and assembly techniques.

It is another object of the present invention to provide a device that is made of a soft material that will be soft to the baby's skin.

It is another object of the present invention to provide a device that is easy to clean.

It is another object of the present invention to provide a device that is aesthetically pleasing, which can be designed in a variety of styles and colors.

It is envisioned that the multiple vibrating mechanism will be placed within the blanket, thus making it a soothing, comforting blanket for older children and even adults. As such, the vibrating baby blanket may have applications in group counseling and individual counseling setting where the patient needs comfort without human contact.

COMPONENT LIST

10 vibrating baby blanket
15 infant blanket case
20 stitching
25 decorative trim
30 vibrating mechanism pocket
35 accessing means
40 vibrating mechanism
45 vibrating baby blanket control unit
50 detachable power cord
55 wall mounted direct current power supply
57 warning indicia
60 upper paddle
65 lower paddle
70 hinge
75 reciprocating unit
80 sliding adjustable track assembly
85 interconnecting cable
90 power switch
95 speed adjustment potentiometer
100 speaker
105 electronic music box unit
106 detachable cord outlet
107 battery compartment door
108 battery set
110 vibrating baby pad
115 infant pad case
120 vibrating baby pad control unit
135 linear travel path arrow
140 direct current gear reduction motor
145 eccentric elliptical actuator
150 output drive shaft
155 reciprocating travel path arrow
160 transformer
165 rectifying diode bridge circuit
170 filter capacitor
175 first switch position
180 second switch position
185 adjustable voltage regulator
190 third switch position
195 limiting resistor

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 4.

DESCRIPTION OF THE PREFERRED EMBODIMENTS

In order to describe the complete relationship of the invention, it is essential that some description be given to the manner and practice of functional utility and description of a vibrating baby blanket.

The best mode for carrying out the invention is presented in terms of its preferred embodiment, herein depicted within the FIGS. 1, 2, 5 & 6.

1. Detailed Description of the Figures

Figure 1:
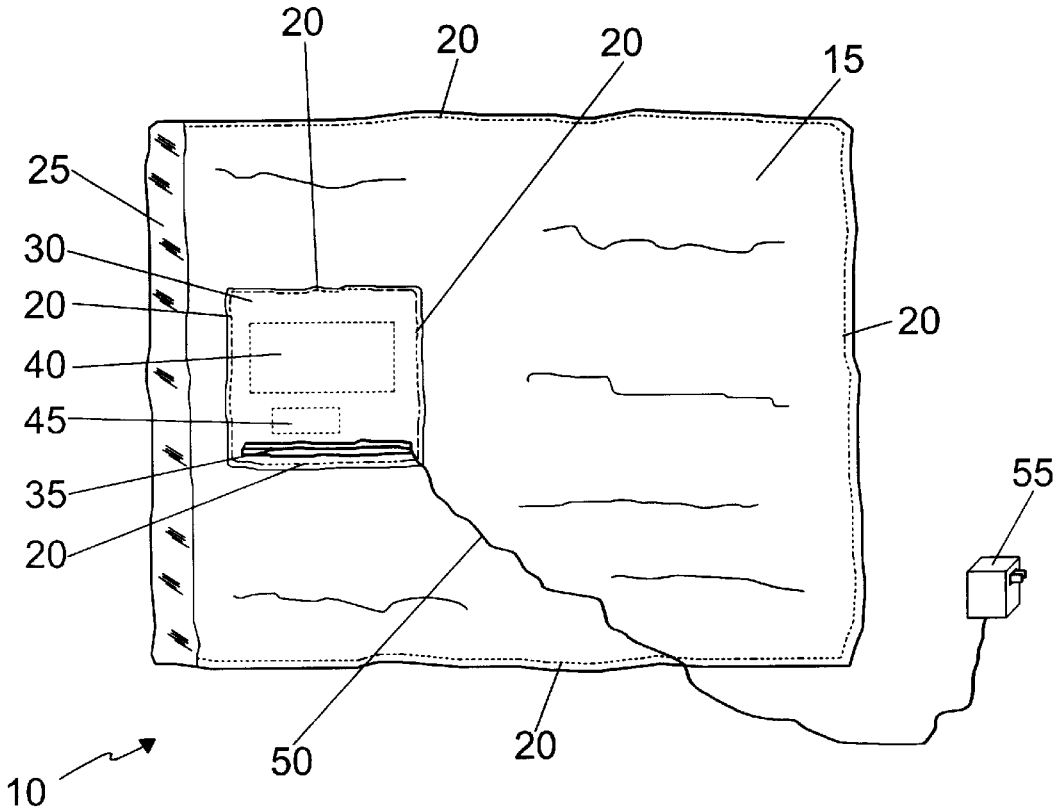
FIG. 1 is a top, plan view of the preferred embodiment of a vibrating baby blanket.

Referring now to FIG. 1, a top plan view of a vibrating baby blanket 10 is depicted, according to the preferred embodiment of the present invention. An infant blanket case 15, manufactured from soft, fire retardant fabric, and hemmed on three sides by stitching 20, and bordered on the top by decorative trim 25 is provided. The infant blanket case 15 is of a conventional nature in design, materials, and composition, and may take on many different appearances. The size of the infant blanket case 15 is such that it may comfortably cover an infant lying in a crib, and may be thought of to be on the order of 36 inches by 48 inches, though it is not intended to be a limiting factor. A vibrating mechanism pocket 30 is provided at the top of the infant blanket case 15, near the decorative trim 25 and is centrally located with relation to the sides of the infant blanket case 15. The vibrating mechanism pocket 30 is physically fastened to the infant blanket case 15 by stitching 20 on all four edges. An accessing means 35, such as a zipper or a VELCRO closure strip is provided along one entire edge of the vibrating mechanism pocket 30 as shown, to provide access to a vibrating mechanism 40 and a vibrating baby blanket control unit 45 (both of which are shown in hidden lines) which will be described in greater detail hereinbelow.

A detachable power cord 50 is shown exiting the accessing means 35 at the one end and is connected to a wall mounted direct current power supply 55. The purpose of the wall mounted, direct current power supply 55 is to allow for keeping voltages of a hazardous level away from the infant's sleeping area and out of the infant's reach.

A warning indicia 57 is located on the anterior surface of the vibrating mechanism pocket 30. The purpose of the warning indicia 57 is to warn parents not to use the detachable power cord 50 when leaving a child unattended, so as to eliminate the risk of accidental strangulation of the child.

Figure 2:
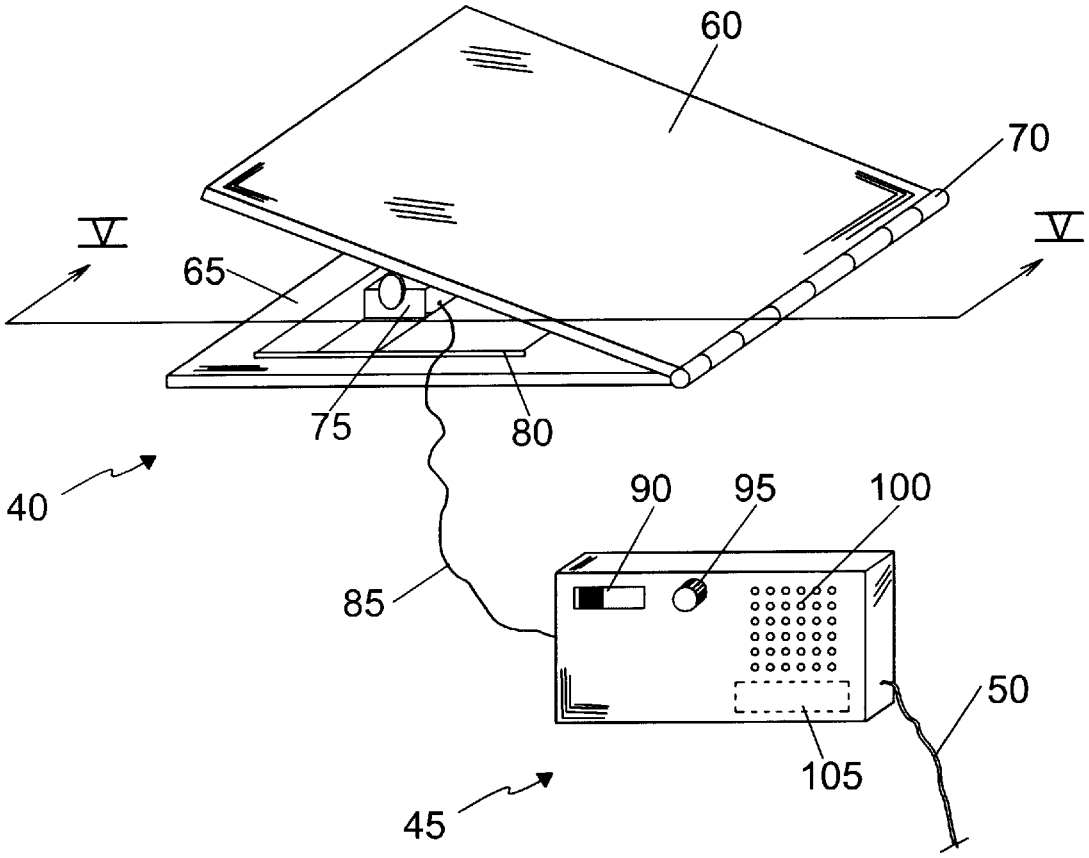
FIG. 2 is a perspective view of the internal components of the vibrating baby blanket according to the preferred embodiment.

Referring next to FIG. 2, a perspective view of the vibrating mechanism 40 and the vibrating baby blanket control unit 45 as used in the infant blanket case 15 (not shown in this FIG.) is shown. The vibrating mechanism 40 consists of an upper paddle 60 and a lower paddle 65 connected along one entire edge of each by a hinge 70. The size of the upper paddle 60 and the lower paddle 65 is intended to mimic the size of an adult human hand and is on the order of 4 inches wide (along the hinge 70 dimension) and 6 inches long, though it is not intended to be a limiting factor. It is envisioned that the upper paddle 60 and the lower paddle 65 would be manufactured from plastic using an injection molding process, though it can be seen by those familiar in the art that other materials and/or methods, such as metal, wood, or other similarly strong material could also be utilized. Located in the interior space between the upper paddle 60 and the lower paddle 65 is a reciprocating unit 75 located on a sliding adjustable track assembly 80. Both the reciprocating unit 75 and the sliding adjustable track assembly 80 will be described in greater detail hereinbelow. An interconnecting cable 85 provides electrical power from the vibrating baby blanket control unit 45 to the vibrating mechanism 40. The vibrating baby blanket control unit 45 is envisioned to be manufactured from plastic, using an injection molding process.

Located on the exterior of the vibrating baby blanket control unit 45 are a power switch 90, a speed adjustment potentiometer 95, a speaker 100. The power switch 90 allows the user to select one of three operating positions for the infant blanket case 15 (not shown in this FIG.). In the first position, the vibrating baby blanket control unit 45 is off and functions as a conventional blanket. In the second position, the vibrating baby blanket control unit 45 provides power to the reciprocating unit 75 and produces a patting or vibrating motion to soothe the infant. The speed adjustment potentiometer 95 varies the speed of the reciprocating unit 75. Additional details on the control of this vibrating motion will be provided hereinbelow. In the third and final position, the vibrating baby blanket control unit 45 provides power to the reciprocating unit 75 as before, but also provides power to an electronic music box unit 105, shown internal to the vibrating baby blanket control unit 45 by hidden lines, which produces a soothing lullaby song through the speaker 100. The song is then heard by the infant through the infant blanket case 15 (not shown in this FIG.) and aids in the further comforting of the infant. The detachable power cord 50 is shown exiting the vibrating baby blanket control unit 45 at the detachable cord outlet 106 where it will connect with the wall mounted direct current power supply 55 (as shown in FIG. 1).

Also located on the exterior of the vibrating baby blanket control unit is a battery compartment door 107 which houses a battery set 108 located internal to the vibrating baby blanket control unit 45 (thus depicted by hidden lines). The battery set 108 provides electrical power to operate the vibrating baby blanket control unit 45 in an environment that would be of the portable nature such as a stroller or car seat, where a wall mounted direct current power supply 55 would not be readily available.

Figure 3:
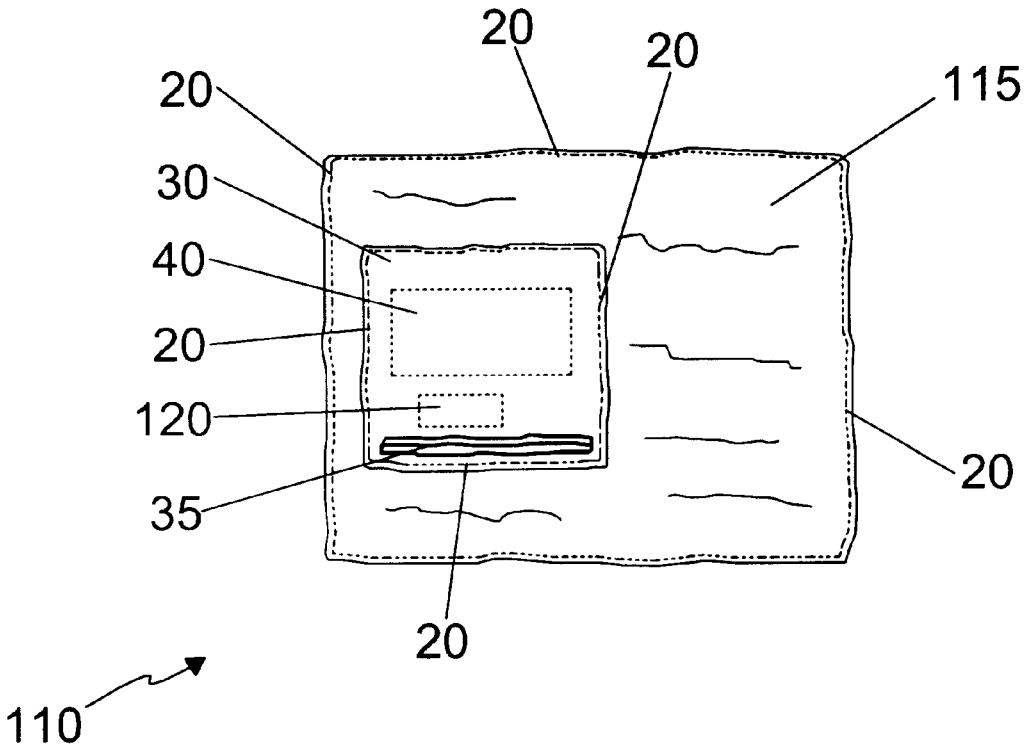
FIG. 3 is a top, plan view of the alternate embodiment of a vibrating baby pad.

Referring now to FIG. 3, a top plan view of a vibrating baby pad 110 is shown according to an alternate embodiment of the present invention. An infant pad case 115, manufactured from soft fabric, and hemmed on three sides by stitching 20, is provided. The infant pad case 115 is of a conventional nature in design, materials, and composition, and may take on many different appearances. The size of the infant pad case 115 is such that it may comfortably cover an infant in a stroller, a car seat or other location while traveling or away from home, and may be thought of to be on the order of 24 inches by 24 inches, though it is not intended to be a limiting factor. The vibrating mechanism pocket 30 is provided at the top of the infant pad case 115, and is centrally located with relation to the sides of the infant pad case 115. The vibrating mechanism pocket 30 is physically fastened to the infant pad case 115 by stitching 20 on all four edges. The accessing means 35, such as a zipper or a VELCRO closure strip is provided along one entire edge of the vibrating mechanism pocket 30 as shown, to provide access to the vibrating mechanism 40 and a vibrating baby pad control unit 120 (both of which are shown in hidden lines) which will be described in greater detail hereinbelow.

Figure 4:
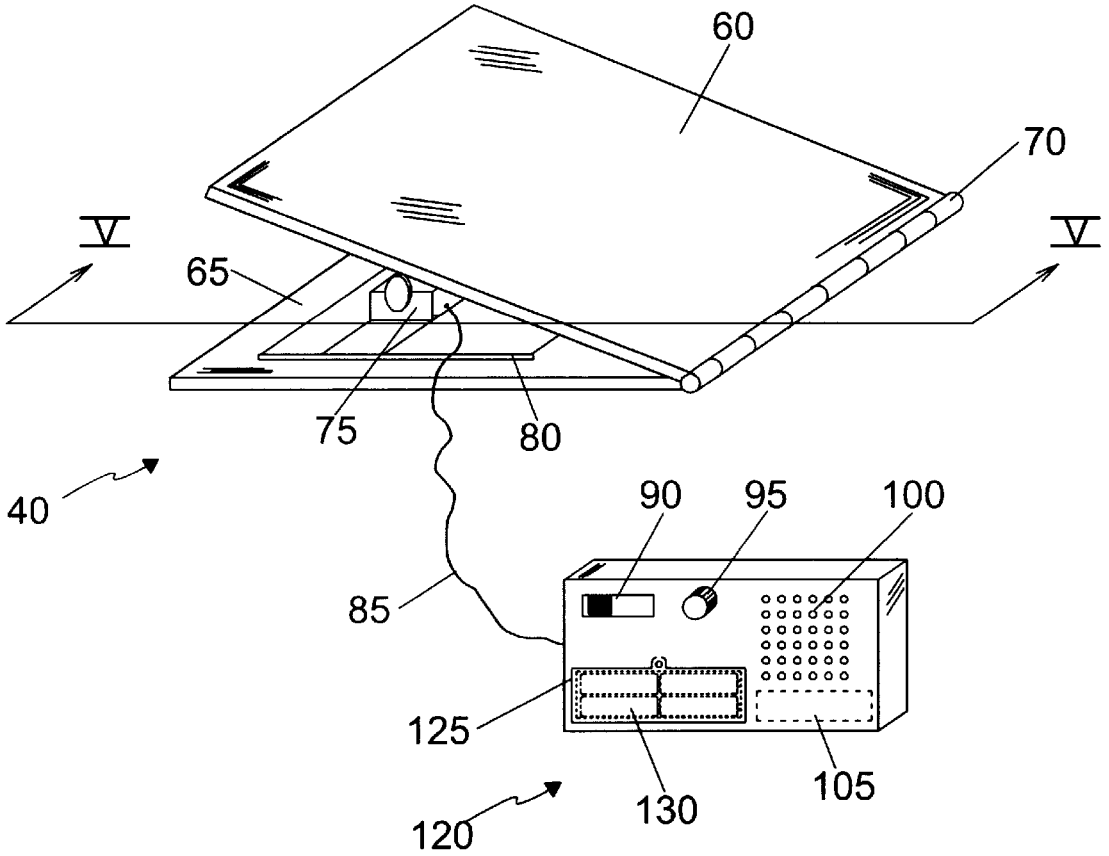
FIG. 4 is a perspective view of the internal components of the vibrating baby pad according to the alternate embodiment of the present invention.

Referring next to FIG. 4, a perspective view of the vibrating mechanism 40 and the vibrating baby pad control unit 120 as used in the infant pad case 115 (not shown in this FIG.) is shown. The vibrating mechanism 40 is identical to the vibrating mechanism 40 as used in the infant blanket case 15 (as described in FIG. 2) and consists of the upper paddle 60, the lower paddle 65, the hinge 70 and the sliding adjustable track assembly 80. The interconnecting cable 85 provides electrical power from the vibrating baby pad control unit 120 to the vibrating mechanism 40. The vibrating baby pad control unit 120 is envisioned to be manufactured from plastic, using an injection molding process. Located on the exterior of the vibrating baby pad control unit 120 are the power switch 90, the speed adjustment potentiometer 95, and the speaker 100 all of which function as described in FIG. 2. Also located on the exterior of the vibrating baby pad control unit 120 is a battery compartment door 107 which houses a battery set 108 located internal to the vibrating baby pad control unit 120 (thus depicted by hidden lines). The battery set 108 provides electrical power to operate the vibrating baby pad control unit 120 in an environment that would be of the portable nature such as a stroller or car seat, where an alternating current power source would not be readily available. The battery set 108 could be rechargeable. Also located internal to the vibrating baby pad control unit 120 is the electronic music box unit 105 which functions in a manner identical to that described in FIG. 2.

Figure 5:
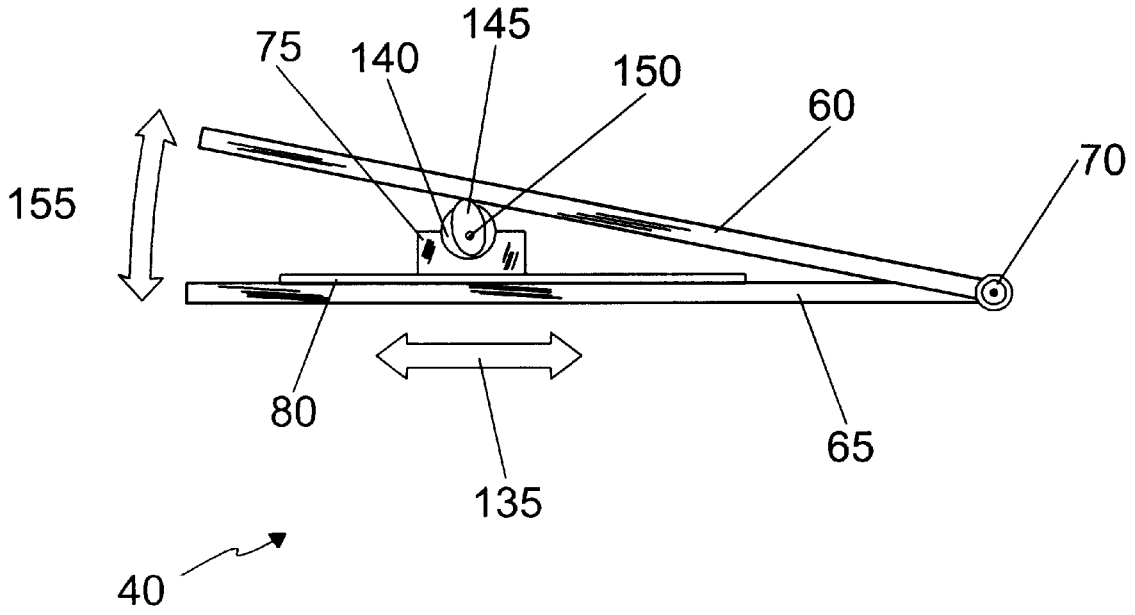
FIG. 5 is a sectional view as seen along a line V—V in FIG. 2.

Referring now to FIG. 5, a sectional view as seen along a line V—V in FIG. 2. and FIG. 4 is depicted. The upper paddle 60 is connected to the lower paddle 65 via the hinge 70 as aforementioned described. The reciprocating unit 75 is positionable by the user along the sliding adjustable track assembly 80 in a multitude of positions as depicted by a linear travel path arrow 135. The reciprocating unit 75 consists of a direct current gear reduction motor 140, coupled to an eccentric elliptical actuator 145 via an output drive shaft 150 of the direct current gear reduction motor 140. The maximum speed of the direct current gear reduction motor 140 is envisioned to be approximately 60 revolutions per minute, or one revolution per second. Thus it can be seen that as the direct current gear reduction motor 140 rotates, it imparts a circular motion onto the eccentric elliptical actuator 145. The eccentric elliptical actuator 145 in turn imparts a reciprocating action onto the upper paddle 60 which generates a reciprocating travel path as defined by a reciprocating travel path arrow 155. The intensity or distance of the reciprocating travel path arrow 155 is governed by the placement of the reciprocating unit 75 along the sliding adjustable track assembly 80 as defined by the linear travel path arrow 135. Thus if the user wishes a vigorous patting action, such as to calm a crying infant, the reciprocating unit 75 would be positioned at the end of the sliding adjustable track assembly 80 nearest the hinge 70. In this position, the lever action would produce a reciprocating travel path arrow 155 on the order of one inch. If the user desired a gentle patting action, such as to aid in putting an infant to sleep, the user would position the reciprocating unit 75 and the end of the sliding adjustable track assembly 80 away from the hinge 70. In this position, the lever action would produce a reciprocating travel path arrow 155 on the order of a quarter of an inch. Additionally, as will be described hereinbelow, the speed of the direct current gear reduction motor 140 is further reduced by electronic circuitry. Therefore, the vibrating or patting action as imparted by the upper paddle 60 and the lower paddle 65 is adjustable in both speed and intensity.

Figure 6:
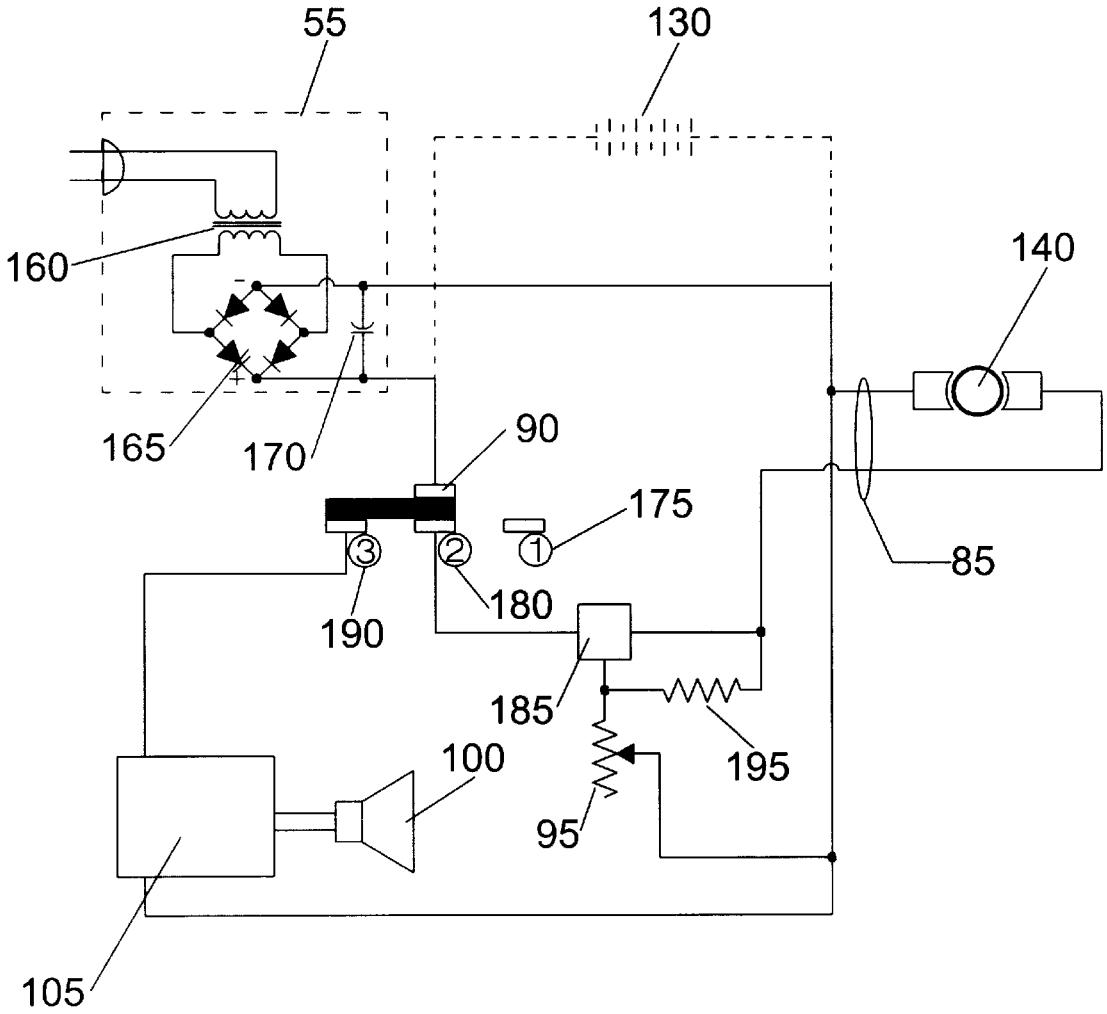
FIG. 6 is a schematic diagram of the electrical circuitry associated with the preferred and alternate embodiment.

Referring finally to FIG. 6, a schematic diagram of the electrical circuitry associated with the vibrating baby blanket 10 in both it's preferred and alternate embodiment is disclosed. In the preferred embodiment of a vibrating baby blanket 10 (as described in FIG. 1 and FIG. 2) the wall mounted direct current power supply 55 is used to provided electric power. The wall mounted direct current power supply 55 consists of a transformer 160, a rectifying diode bridge circuit 165 and a filter capacitor 170, used to produce direct current in a conventional, readily known manner. It is envisioned that the voltage level produced would be on the order of six volts. In the alternate embodiment of a vibrating baby pad 110 (as described in FIG. 3 and FIG. 4) the battery set 108 would produce the necessary six volts and is shown in dotted lines connecting to the same electrical points as the wall mounted direct current power supply 55. At this point on, the remainder of the electrical circuitry is identical and functions in an identical manner. The positive signal is then routed through the power switch 90. In a first switch position 175 no electric power is transmitted, and the vibrating baby blanket control unit 45 or the vibrating baby pad control unit 120 (as shown in FIG. 2 and FIG. 4., respectively) is essentially off. In a second switch position 180, power is only applied to an adjustable voltage regulator 185 of conventional design. In a third switch position 190, as depicted in this FIG., power is applied to the electronic music box unit 105 as well as the adjustable voltage regulator 185. The electronic music box unit 105 would then play preprogrammed lullabies through the speaker 100 as conventionally designed and readily available. The adjustable voltage regulator 185 imparts a reduced voltage to the direct current gear reduction motor 140 via the interconnecting cable 85, as governed by a limiting resistor 195 and controlled by the speed adjustment potentiometer 95 through a feedback loop.

2. Operation of the Preferred Embodiment

To use the present invention, the user would first adjust the intensity of the patting or vibrating motion by positioning the reciprocating unit 75 on the sliding adjustable track assembly 80 as desired. Next, the wall mounted direct current power supply 55 would be connected to a source of alternating current. Now the power switch 90 would be activated to produce a patting motion or a patting motion in addition to a lullaby song. The user at this point would adjust the speed of the patting motions by the speed adjustment potentiometer 95. The vibrating baby blanket 10 is then ready for use.

The vibrating baby blanket 10 is then placed over the child's body, excluding the head area. While the infant peacefully sleeps or relaxes, the vibrating mechanism 40 in the vibrating baby blanket 10 vibrates to provide a soothing, methodic patting sensation. When the vibrating baby blanket is no longer needed to function as a soothing massage device, the power switch 90 is turned to the off position. The vibrating baby blanket may be used without the vibrating feature.

If the infant soils the vibrating baby blanket 10, the user may remove the vibrating mechanism 40 and the vibrating baby blanket control unit 45 and wash the infant blanket case 15 in a conventional manner. When cleaned and dry, the vibrating mechanism 40 and the vibrating baby blanket control unit 45 may be replaced to repeat the above cycle.

The alternate embodiment of the vibrating baby blanket 10 depicted by the vibrating baby pad 110 would function in a similar manner, but would not need to be connected to a source of external electrical power. In lieu of external electrical power, the user would provide a battery set 108 to be utilized inside of the vibrating baby pad control unit 120. The battery set 108 could be rechargable.

The foregoing description is included to illustrate the operation of the preferred embodiment and is not meant to limit the scope of the invention. The scope of the invention is to be limited only by the following claims.

What is claimed is:

1. A vibrating baby blanket comprising:

an infant blanket case, said infant blanket case manufactured from soft, fire retardant fabric, and hemmed on three sides by stitching, and bordered on the top by decorative trim;

a vibrating mechanism, wherein said vibrating mechanism consists of an upper paddle, said upper paddle having at least one edge, and the size of said upper paddle intended to mimic the size of an adult human hand and is on the order of 4 inches wide and 6 inches long, manufactured from plastic using an injection molding process;

a lower paddle, said lower paddle having at least one edge; and the size of said lower paddle intended to mimic the size of an adult human hand and is on the order of 4 inches wide and 6 inches long, manufactured from plastic using an injection molding process;

a hinge, said hinge connecting said upper paddle and said lower paddle along one entire edge of each;

a reciprocating unit, said reciprocating unit located in the interior space between said upper paddle and said lower paddle and further comprises:

a direct current gear reduction motor, coupled to an eccentric elliptical actuator via an output drive shaft of the direct current gear reduction motor, with the maximum speed of said direct current gear reduction motor to be approximately 60 revolutions per minute, or one revolution per second, such that as said direct current gear reduction motor rotates, it imparts a circular motion onto said eccentric elliptical actuator, with said eccentric elliptical actuator, in turn, imparting a reciprocating action onto said upper paddle which generates a reciprocating travel path a vibrating baby blanket control unit for controlling said vibrating mechanism, said vibrating baby blanket control unit having an exterior, and being rectangular in configuration;

an interconnecting cable, said interconnecting cable used to communicate between said vibrating baby blanket control unit to said vibrating mechanism;

a vibrating mechanism pocket, said vibrating mechanism pocket located at said top of said infant blanket case, near the decorative trim, and centrally located with relation to said sides of said infant blanket case; said vibrating mechanism pocket being physically fastened to said infant blanket case by stitching on all four edges;

an accessing means, said accessing means located along one entire edge of said vibrating mechanism pocket, and designed to provide access to said vibrating mechanism and said vibrating baby blanket control unit, a direct current power supply, the purpose of said direct current power supply being the keeping of voltages of a hazardous level away from the infant's sleeping area and out of the infant's reach;

a detachable power cord, said detachable power cord being connected to said vibrating baby blanket control unit and detachable from said vibrating baby blanket control unit, where it will pass through said accessing means and connects with the wall mounted, direct current power supply; and a warning indicia, said warning indicia being located on the anterior surface of said vibrating mechanism pocket, and designed to warn parents not to use said detachable power cord when leaving a child unattended, so as to eliminate the risk of accidental strangulation of the child; and a sliding adjustable track assembly, said reciprocating unit being located on said sliding adjustable track assembly and capable of being moved in a multitude of locations along said sliding adjustable track assembly.

2. The vibrating baby blanket described in claim 1, wherein said vibrating baby blanket is washable, such that if the infant soils said vibrating baby blanket, the user may remove said vibrating mechanism and said vibrating baby blanket control unit and wash said infant blanket case in a conventional manner, and when cleaned and dry, said vibrating mechanism and said vibrating baby blanket control unit may be replaced to repeat the above cycle.

3. The vibrating baby pad of claim 2, wherein no external source of power is needed, such that said vibrating baby pad is portable, being able to be used outside the home or in locations where power outlets are difficult or impossible to reach.

4. The vibrating baby blanket described in claim 1, wherein a vibrating baby pad is used instead of a blanket, said vibrating baby pad comprising:

an infant pad case, said infant pad case serving the same function as said infant blanket case, said infant pad case having a top and at least three sides, said infant pad case manufactured from soft fabric, is of a conventional nature in design, materials, and composition, with a size such that it may comfortably cover an infant in a stroller, a car seat or other location while traveling or away from home; said infant pad case being hemmed on three sides by stitching;

a vibrating mechanism, said vibrating mechanism functioning identically to said vibrating mechanism in said vibrating baby blanket;

a vibrating baby pad control unit, said vibrating baby pad control unit having an exterior, and functioning essentially the same as said vibrating baby blanket control unit a vibrating mechanism pocket, said vibrating mechanism pocket serving the same function as said vibrating mechanism pocket of said vibrating baby blanket, said vibrating mechanism pocket having at least one edge, said vibrating mechanism pocket being located at the top of said infant pad case, and is centrally located with relation to the sides of said infant pad case, being physically fastened to said infant pad case by stitching on all four edges;

an accessing means, said accessing means serving the same function as said accessing means of said vibrating baby blanket, said accessing means providing access to said vibrating mechanism and said vibrating baby pad control unit;

an interconnecting cable, said interconnecting cable used to provide power from said vibrating baby pad control unit to said vibrating mechanism.

5. The vibrating baby pad control unit described in claim 4, said vibrating baby pad control unit manufactured and operating identically to said vibrating baby blanket control unit, without the detachable power cord, but including:

a battery set, said battery set being located internal to said vibrating baby pad control unit, said battery set providing electrical power to operate said vibrating baby pad control unit;

a battery compartment door, said battery compartment door being located on said exterior of said vibrating baby pad control unit.

6. The vibrating baby blanket described in claim 1, wherein said vibrating baby blanket produces a patting vibration the approximate size of a parent's outstretched hand.

7. The vibrating baby blanket described in claim 1, wherein said vibrating baby blanket produces a patting vibration of varying speed and intensity.

8. The vibrating baby blanket described in claim 1, wherein no external source of power is needed, such that said vibrating baby blanket is portable, being able to be used outside the home or in locations where power outlets are difficult or impossible to reach.

* * * * *